US005662212A

United States Patent [19]

Wecke et al.

[11] Patent Number: 5,662,212

[45] Date of Patent: Sep. 2, 1997

[54] RADIUS ACTUATOR FOR A SAFETY SWITCH

[75] Inventors: Rolf Wecke, Bückeburg; Roland Mönnings, Porta Westfalica; Ralph Hoppmann, Minden, all of Germany

[73] Assignee: Hans Bernstein Spezialfabrik für Schaltkontakte GmbH & Co., Porta Westfalica, Germany

[21] Appl. No.: 538,412

[22] Filed: Oct. 2, 1995

[30] Foreign Application Priority Data

Oct. 11, 1994 [DE] Germany ..... 44 36 199.8

[51] Int. Cl.[6] ..... H01H 27/00

[52] U.S. Cl. ..... 200/43.04; 200/329; 200/43.07

[58] Field of Search ..... 200/43.09, 563, 200/11 TU, 11 R, 557, 329, 43.07; 74/96, 107

[56] References Cited

U.S. PATENT DOCUMENTS 3,591,747 7/1971 Dennison ..... 200/557

5,285,039 2/1994 Satoh ..... 200/563

5,286,935 2/1994 Mina et al. ..... 74/96

*Primary Examiner*—David J. Walczak

*Attorney, Agent, or Firm*—Henry M. Feiereisen

[57] ABSTRACT

A radius actuator for a safety switch includes a mounting, a spring-loaded operating key secured in the mounting and moveable between a slanted initiation position and a switch-actuating position. The operating key has a head assembly which is spring-mounted in a slider that is received in a recess of a locking wheel for to and fro movement. The locking wheel is rotatably supported in a mounting and has a cam so that a turning of the locking wheel causes the cam to move the slider in a direction of movement. The head assembly is supported outside the slide for tilting about a pivot axis in order to effect a slanted position of the operating key relative to the safety switch when turning the locking wheel.

20 Claims, 9 Drawing Sheets

RADIUS ACTUATOR FOR A SAFETY SWITCH

BACKGROUND OF THE INVENTION

The present invention refers to a radius actuator for a safety switch, and in particular to a radius actuator including a mounting and a spring-loaded operating key that is movable between an initiation position and a switch-operating position.

Safety switches are used to cut the current supply when, for example, a protective cover is removed from an equipment or a machine or when equipment access doors and cabinet doors are opened. Such safety switches typically are formed with a plurality of access openings that face in different directions for entry of a radius actuator to operate the switch. The actuator is suitably secured to a flap, door, or lid at a predetermined distance from the flap axis or rotational axis thereof and moves together with the door, flap or the like.

Such radius actuators are utilized when the actuator can only be affixed to the door flap or lid at a small swiveling radius relative to the safety switch, with the radius actuator being configured as to occupy a slanted position (initiation position) in relation to the safety switch in the initiation phase. Thus, the radius actuator can readily enter the safety switch through its access opening at a small swiveling radius, but still can assume an actuating position that is substantially perpendicular to the switch element being actuated upon further travel for operation of e.g. a switch wheel of such a safety switch. The force exerted by the spring effects a return of the operating key of the radius actuator into the initiation position after exiting the safety switch.

Such radius actuators are disclosed, for example, in DE-U-88 07 681 and DE-U-88 07 682. The slanted initiation position in conventional radius actuators is set by adjustment screws by which the swivel angle is adjustable upon installed radius actuator. The adjustment frequently has to be performed in a tight area and thus becomes complicated since the precise adjustment of the screws with a tool is difficult. There is also a risk of completely unscrewing the screw which thus may get lost may cause the operating key to fall out of the mounting.

It is possible to suit the adjustments of conventional radius actuators to a right-hand stop or a left-hand stop, however prevailing spatial conditions for the safety switch require for some applications a slanted position of the operating key with respect to its broad side, and in other applications to turn the operating key by 90° for slanted position with respect to its narrow side. Thus, to date two different radius actuator types are required.

SUMMARY OF THE INVENTION

It is an object of the present invention to provide an improved radius actuator, obviating the afore-stated drawbacks.

In particular, it is an object of the present invention to provide an improved radius actuator of this general type which is convenient to operate and can be easily adjusted on site to the small swiveling radius in relation to the safety switch.

These objects and others which will become apparent hereinafter are attained in accordance with the present invention by providing the operating key with an head assembly that is spring-mounted in a slider for to and fro motion relative to the slider, and by providing a hand-operated control mechanism in the mounting for moving the slider in both directions of movement, with the head assembly being supported outside the slider by the mounting for tilting about a pivot axis.

In accordance with the present invention, the installed radius actuator can be readily adjusted manually on site by the control mechanism in the mounting to the desired position to suit the swiveling radius with respect to the position of the safety switch, without any need for tools. The displacement of the head assembly of the operating key through the slider in conjunction with the tiltable support outside the slider effects the desired slanting of the operating key, whereby the spring-mounted support of the head assembly in both directions of movement of the slider ensures that the operating key can assume a substantially perpendicular alignment within the slider after entering the safety switch in the initiation phase and that after exiting the safety switch, the operating key returns automatically to its previous slanted position.

In accordance with a further preferred embodiment, the control mechanism includes a locking wheel which is rotatably supported in toothed rim sections of the mounting and placeable in two mutually orthogonal orientations. The locking wheel has a recess that is defined by a control cam, with the slider being slidably received in the recess of the locking wheel. Thus, a single radius actuator enables a positioning of the operating key in different tilting positions relative to its broad side as well as to its narrow side.

The requirements for the radius actuator are specified by a customer when placing an order for a particular application. The desired tilt of the operating key is simply effected by the manufacturer through suitable insertion of the locking wheel in a basic position in the mounting to effect a particular displacement plane for the slider and thus slanted position of the operating key. An insertion of the locking wheel in a position offset by 90° results in a correspondingly shifted motion plane for the slider and thus also a 90° offset motion plane for the operating key with regard to its slanted position in the initiation position. Production and storage of such universally insertable radius actuators becomes thus greatly simplified.

It is apparent from the foregoing description that the radius actuator can easily be suited to a right-hand stop or left-hand stop on site within the selected motion plane of the slider through its mobility to and fro by means of the control mechanism.

Preferably, the mounting and the locking wheel are dimensioned such that the locking wheel partially protrudes from the mounting for allowing manual actuation thereof.

A tiltable support of the head assembly of the operating key is effected by providing the mounting with a through-opening at a location outside the slider, with the through-opening being formed by a circumferential bead-like configuration of substantially triangular cross-section.

According to another feature of the present invention, the mounting is formed of two identical mounting parts that interlock together around the locking wheel. The mounting parts of the mounting have lateral attachment lugs which engage each other upon assembly of the mounting and include bores for passage of screw fasteners.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
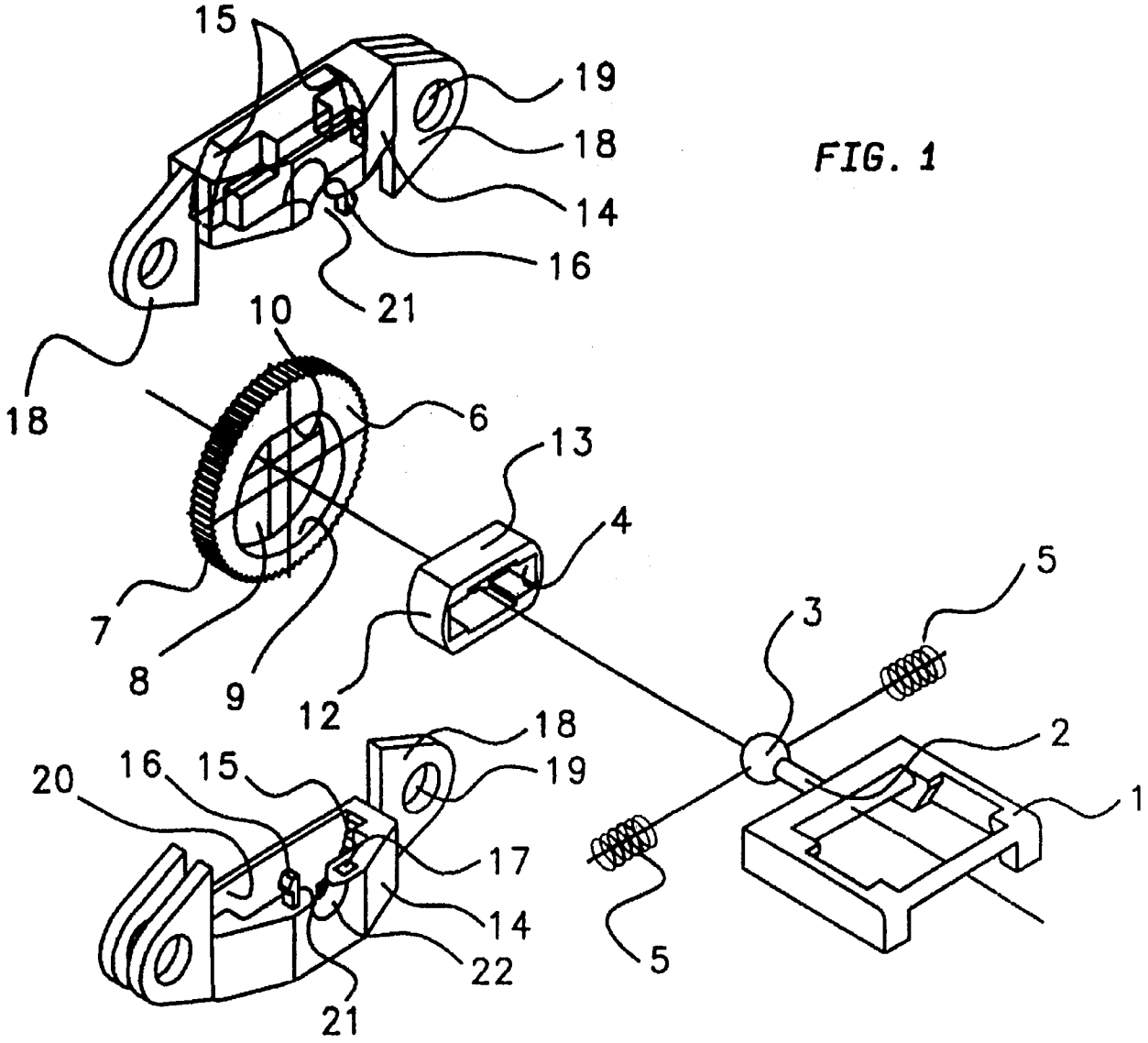
FIG. 1 is an exploded view of one embodiment of a radius actuator in accordance with the invention, illustrating the components of the radius actuator for insertion of the operating key in a first tilting plane.

Throughout all the Figures, the same or corresponding elements are always indicated by the same reference numerals.

Turning now to the drawing, and in particular to FIG. 1, there is shown an exploded view of one embodiment of a radius actuator in accordance with the present invention for operation of a safety switch. The radius actuator includes an operating key 1 in form of a shackle or stirrup, having one operating end for engagement with matching cam contours formed on a switch wheel inside the safety switch. The safety switch and its components, such as the switch wheel and electric components and circuitry, do not form part of the present invention and thus are not shown in detail for sake of simplicity.

At its end distant to the operating end, the operating key 1 is formed with a head assembly in form of a projecting rod 2 of circular cross section that has one end secured to the operating key 1 and another end in form of a sphere 3 which is received in a slot of a slider 4, with the position of the sphere 3 in the slider 4 being secured by springs 5 during displacement of the slider 4 in both directions, as will be described furtherbelow.

The slider 4 is placed within a control mechanism in the form of a locking wheel 6 that is preferably made of plastic material of certain elasticity. The locking wheel 6 is formed with an external fine pitch toothing 7 and has a recess 8 which receives the slider 4. The recess 8 is defined by a circular section 9 which is diagonally opposed by a control cam 10 that is significantly closer to an imaginary center of the recess 8 than the opposing circular section 9. In the transition zone between the circular section 9 and the cam 10, the recess 8 is widened in a direction perpendicular to the above-mentioned diagonal. This non-circular cross-sectional configuration of the recess 8 is suited to the external contour of the slider 4 which is of elongated configuration and has rounded portions 12 at each of its two longitudinal ends. The rounded portions 12 merge into opposing flat boundary surfaces 13.

The radius actuator further comprises a mounting 14 which is composed of two identical mounting parts. Each mounting part is formed of two substantially opposing end faces with a toothed rim section 15 which define with a rear wall 20 a cavity for receiving the locking wheel 6, whereby the toothed rim sections 15 elastically mesh with the external toothing 7 of the locking wheel 6. The mounting 14 with its mounting parts has a height as to allow in the assembled state, shown in FIG. 2, a circumferential area of the locking wheel 6 to protrude above and below from the mounting 14 to thereby facilitate a manual rotation of the locking wheel 6.

Each mounting part of the mounting 14 has a detent 16 and a locking bore 17 to snap the mounting parts together, with the detent 16 of one mounting part engaging the bore 17 of the other mounting part. As further shown in FIG. 1, each mounting part of the mounting 14 has longitudinal ends, with one end formed with a single central attachment lug 18 and with the other end formed with two lateral attachment lugs 18. Each attachment lug 18 is provided with a hole 19. Upon assembling the mounting 14, the attachment lugs 18 of the mounting parts engage within each other, with the holes 19 being aligned to enable attachment of the mounting 14 to a cover, flap door or the like at a predetermined distance from the tilting axis thereof, by means of screw fasteners.

In order to allow an angular displacement of the operating key 1 relative to the mounting 14, the rod 2 extends from the sphere 3 in direction toward the operating key 1 through an opening 21 of the mounting 14. The opening 21 is defined by an inner wall surface in form of a bead-like configuration of substantially enlarged triangular cross section to define a pivot axis about which the operating key 1 is tilted. The pivot axis is thus positioned outside the slider 4 in an area closer to the operating key 1.

Figure 2:
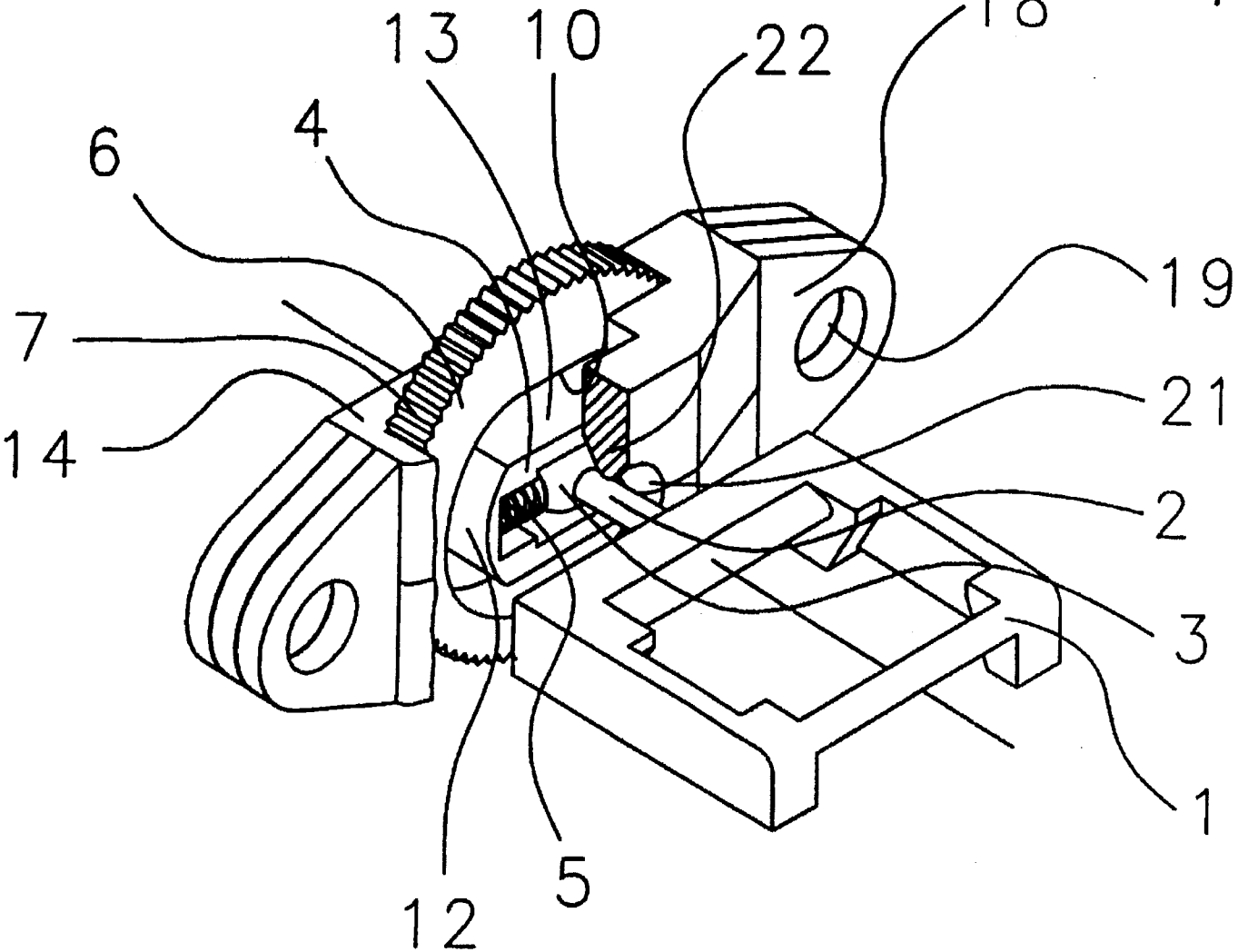
FIG. 2 is a partially sectional, perspective view of the radius actuator of FIG. 1, depicting the assembled state of the radius actuator with inserted operating key.

In the assembled state, shown in FIG. 2, the locking wheel 6 is placed in the cavity of the mounting 14 with control cam 10 positioned at the top. The slider 4 is inserted into the locking wheel 6, with the upper plane boundary surface 13 of the slider 4 being positioned adjacent the control cam 10. The sphere 3 of the operating key 1 is spring-mounted in the slider 4 and secured in place by the springs 5 on either side of the sphere 3.

Figure 3:
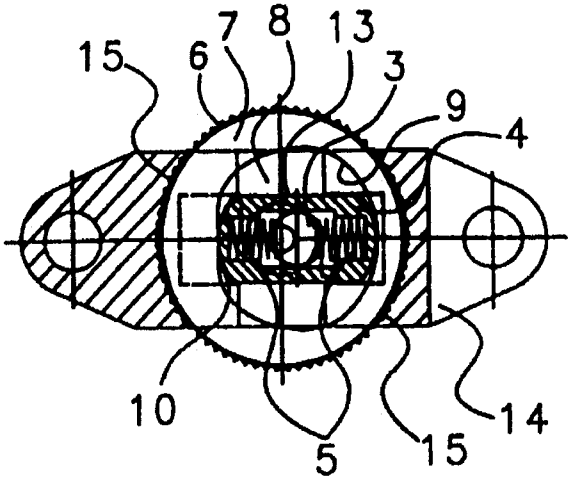
FIG. 3 is a partially sectional plan view of the radius actuator in accordance with FIG. 2.
Figure 3B:
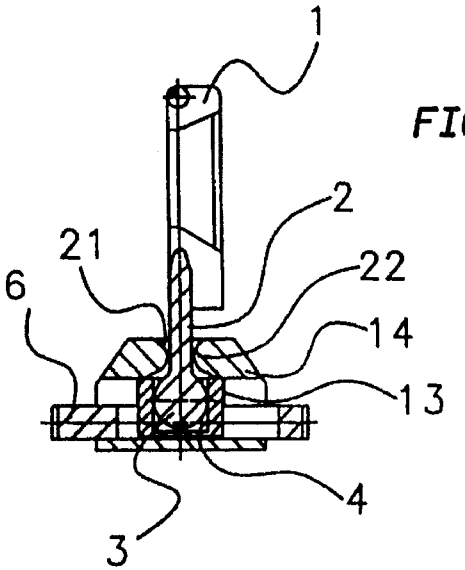
FIG. 3*b* is a partially sectional narrow side elevation of the radius actuator according to FIG. 3*a;*
Figure 3A:
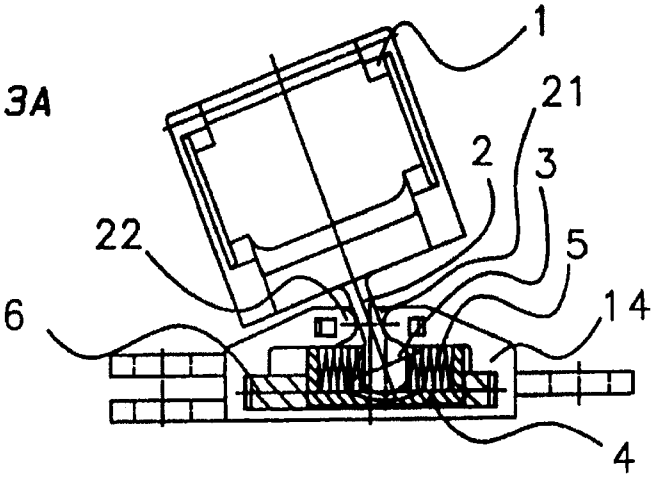
FIG. 3*a* is a partially sectional broad side elevation of the radius actuator according to FIG. 3, illustrating the slanted position of the operating key.

FIG. 2 shows the neutral (initial) position before setting the operating key 1 into the desired slanted initiation position. When turning the locking wheel 6 from this neutral position counterclockwise, the cam 10 of the locking wheel 6 reaches one of the rounded portions 12 on the outside of the slider 4 so that the slider 4 is shifted laterally within the locking wheel 6 such that an imaginary center of recess 8 is positioned eccentric relative to the rotational axis of the locking wheel 6, as shown in FIG. 3. Thus, this displacement of the slider 4 in cooperation with the tiltable support of the rod 2 in the opening 21 of the mounting 14 effects a desired slanted position of the operating key 1, as shown in FIG. 3*a*, with the slanted position being effected in this configuration of the locking wheel 6 in mounting 14 via the broad side of the operating key 1. FIG. 3*b* shows a side view of the slanted position of the operating key 1. The initiation position of the radius actuator with the slanted position of the operating key 1 is maintained by the locking mechanism.

A turning of the locking wheel 6 from the neutral position in a clockwise direction causes the slider 4 to move sideways in the other direction when the cam 10 of the locking wheel 6 hits the other rounded portion 12 of the slider 4. Thus, the operating key 1 is slanted in an opposite direction relative to an imaginary vertical in the illustration in FIG. 3*a*. Through respective turning of the locking wheel 6, the slanted position of the operating key 1 can easily be suited to a left-hand stop or right-hand stop of the flap, door, casing or the like that supports the mounting 14.

Figure 1A:
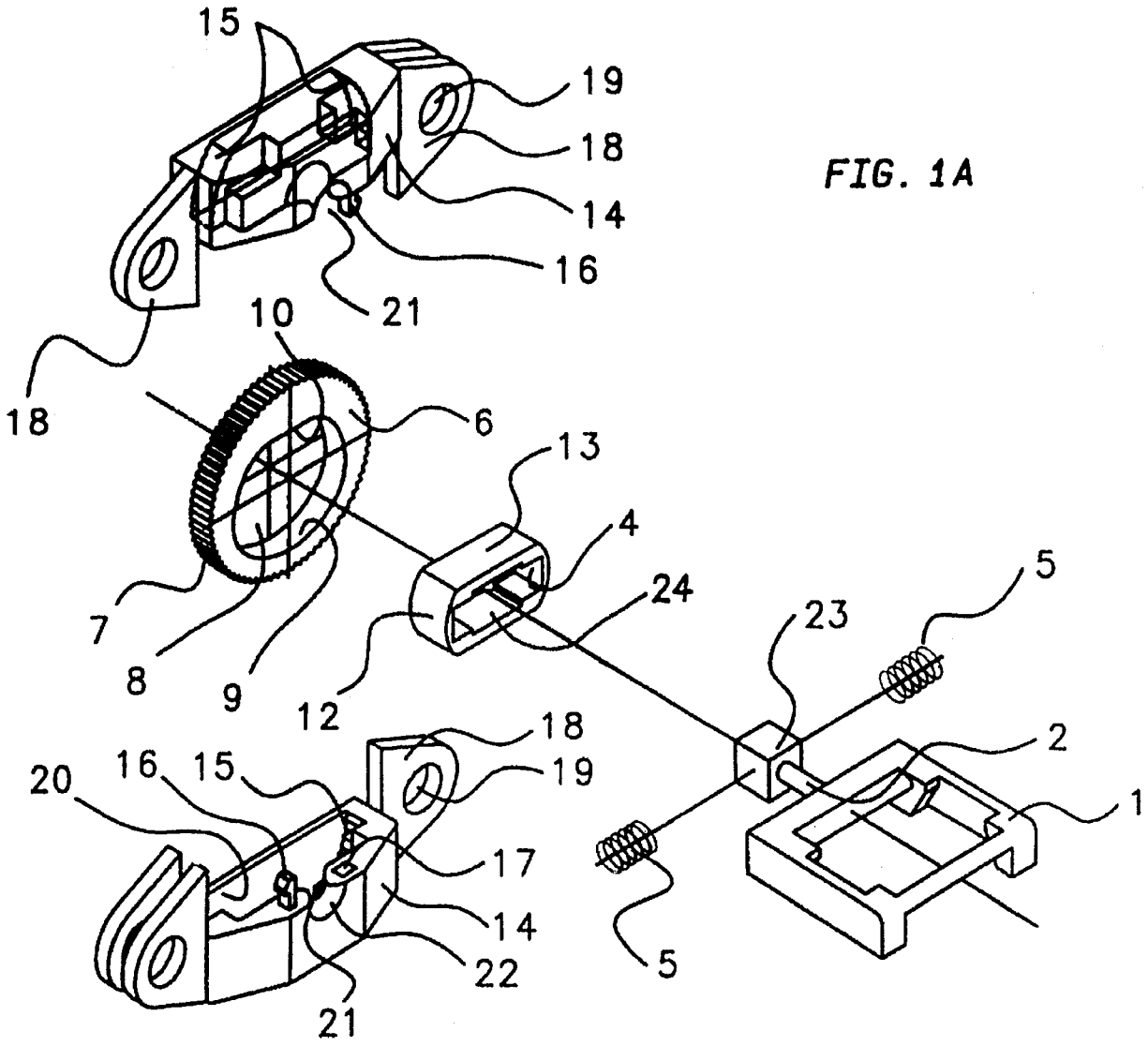
FIG. 1*a* is an exploded view of the radius actuator of FIG. 1 with modified operating key.

FIG. 1*a* is an exploded view of the radius actuator of FIG. 1 with modified operating key 1 in which the rod 2 terminates in an end piece 23 of square or cubical configuration which is received in conforming guide surfaces 24 of the slider 4. The square configuration prevents a rotation of the operating key 1 from outside about its axis.

Figure 4:
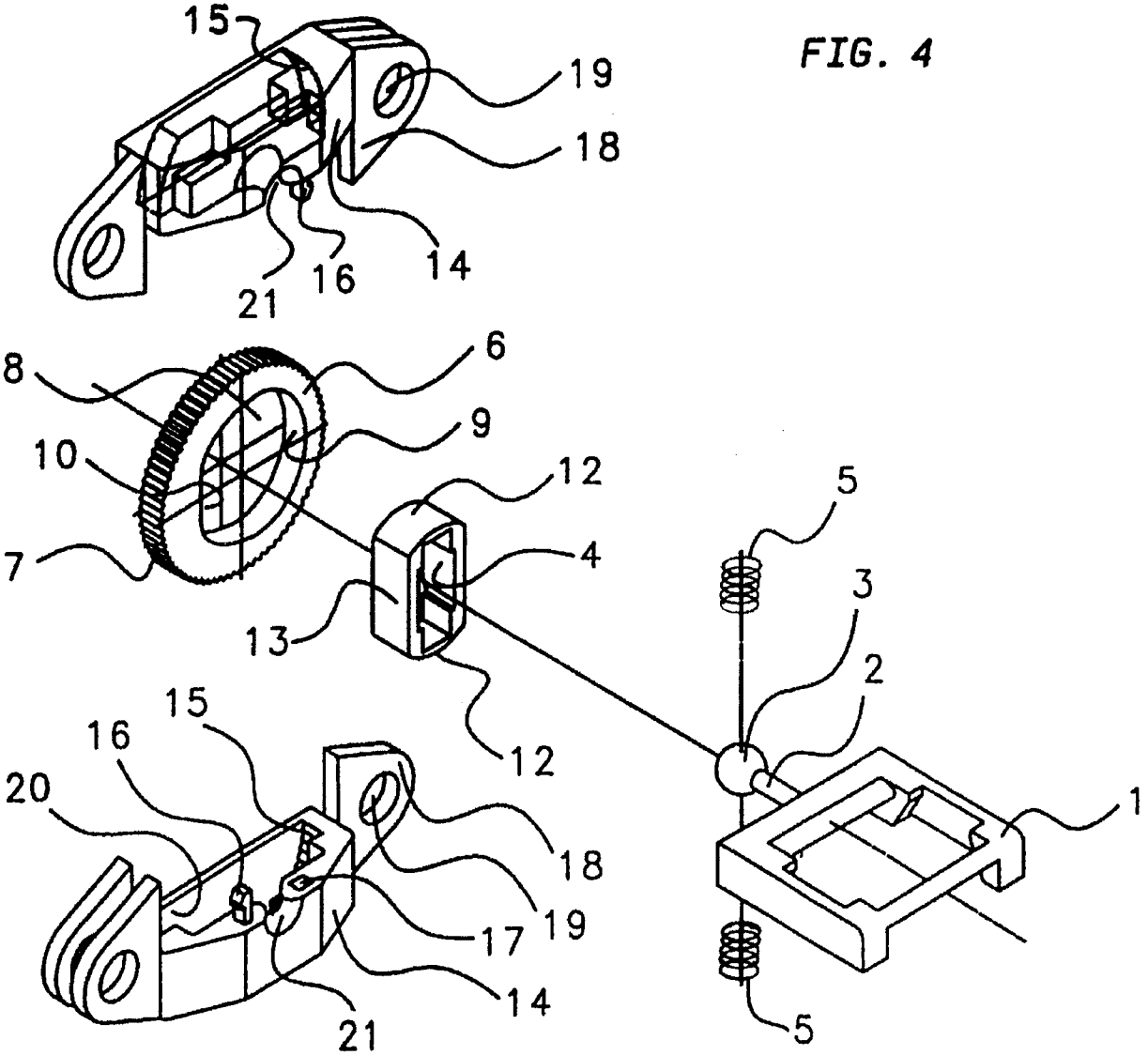
FIG. 4 is an exploded view of the radius actuator of FIG. 1, for insertion of the operating key from a tilting plane that is offset by 90° to the first tilting plane shown in FIG. 1.
Figure 5:
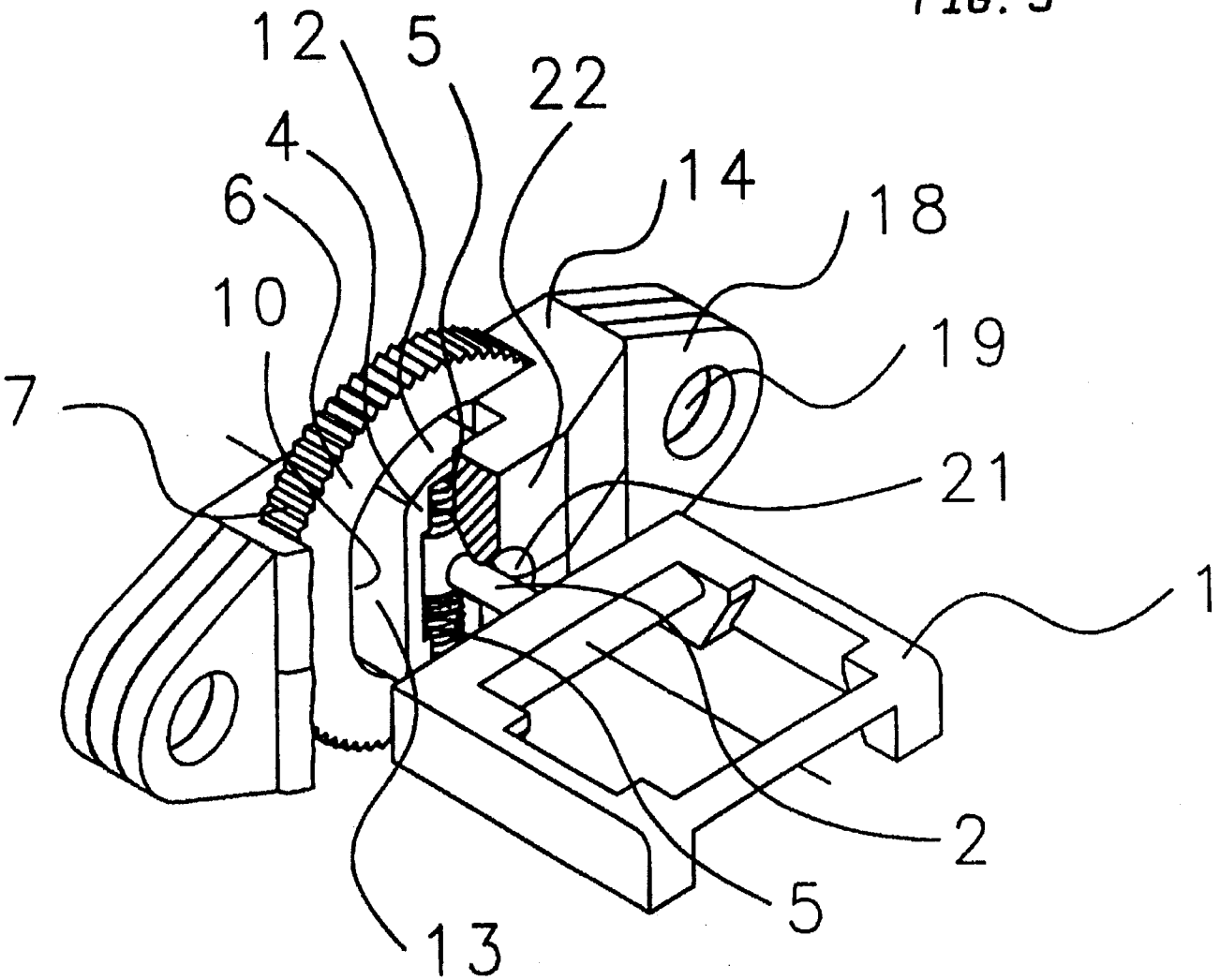
FIG. 5 is a partially sectional plan view of the radius actuator in accordance with FIG. 4.

Turning now to FIG. 4, there is shown an exploded view of the radius actuator of FIG. 1, for insertion of the operating key 1 from a slanted position via its narrow side that is offset by 90° to the tilting plane shown in FIG. 1. While maintaining the interrelationship of the mounting parts of the mounting 14 and of the operating key 1, the slanted position of the operating key 1 in the neutral position via the narrow side can simply be accomplished by placing the locking wheel 6 in the cavity of the mounting 14 at an orientation in which the cam 10 extends laterally (at the left hand side in FIG. 4). The slider 4 is received in the recess 8 in a same relationship, i.e. one of the planar boundary surfaces 13 extends adjacent the cam 10. The operating key 1 is secured in the slider 4 of the mounting 4 by the springs 5 which are positioned on both sides above and below the sphere 3. The assembled state is illustrated in FIG. 5.

Figure 6:
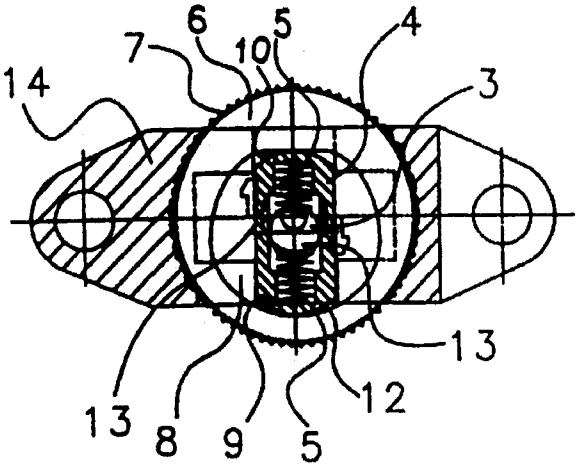
FIG. 6 is a partially sectional plan view of the radius actuator in accordance with FIG. 5, illustrating a corresponding slanted position of the operating key.
Figure 6A:
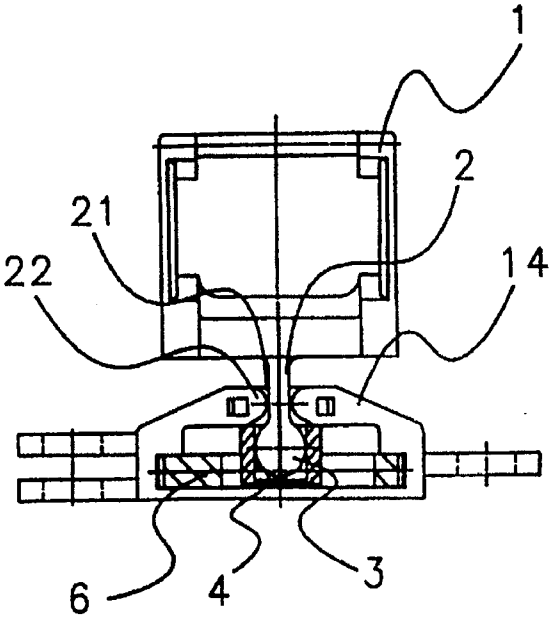
FIG. 6*a* is a partially sectional side view of the radius actuator of FIG. 6.
Figure 6B:
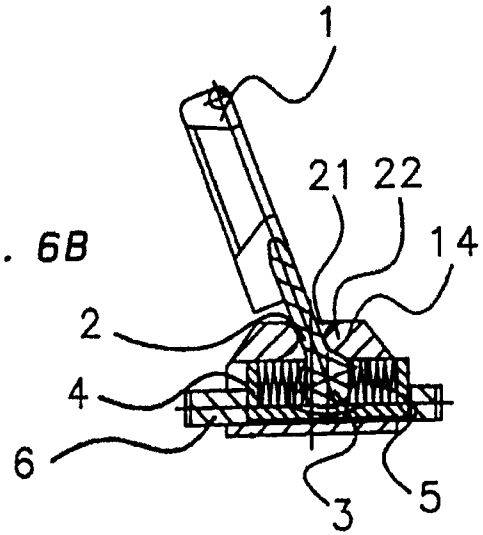
FIG. 6*b* is a partially sectional narrow side elevation of the radius actuator of FIG. 6*a*, illustrating the slanted position of the operating key.

When turning the locking wheel 6 from this neutral (initial) position, e.g. in a clockwise direction, the cam 10 moves upwards to force the slider 4 downwards, as shown in FIG. 6. Thus, since the rod 2 with its sphere 3 is tiltably supported in the opening 21 of the mounting 14, the operating key 1 occupies a slanted position in another plane of motion as compared to the previously described assembly position of the locking wheel 6. As shown by the side view of FIG. 6*b*, the operating key 1 is now at an angled or slanted position via the narrow side. FIG. 6*a* shows a plan view upon the radius actuator.

A rotation of the locking wheel 6 in the other direction, i.e. counterclockwise, effects a slanted position of the operating key 1 at the opposite angle with respect to an imaginary vertical to suit the radius actuator to a left-hand stop or a right-hand stop.

Figure 7B:
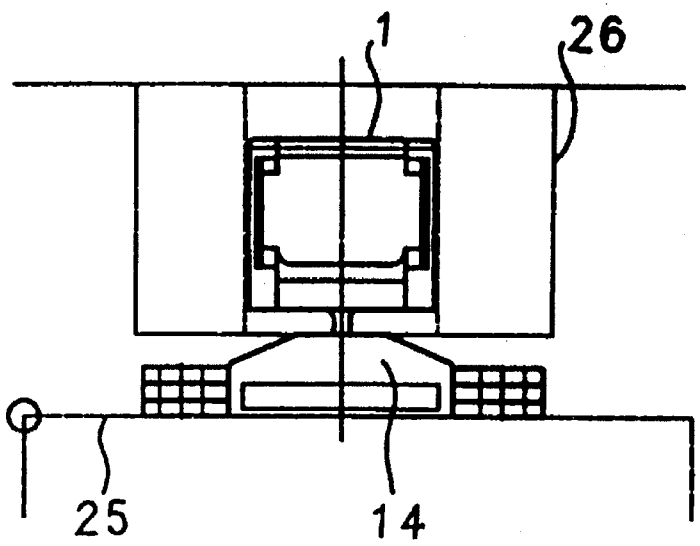
FIG. 7*b* is a schematic illustration of the radius actuator of FIG. 7*a* after entering the safety switch.
Figure 7A:
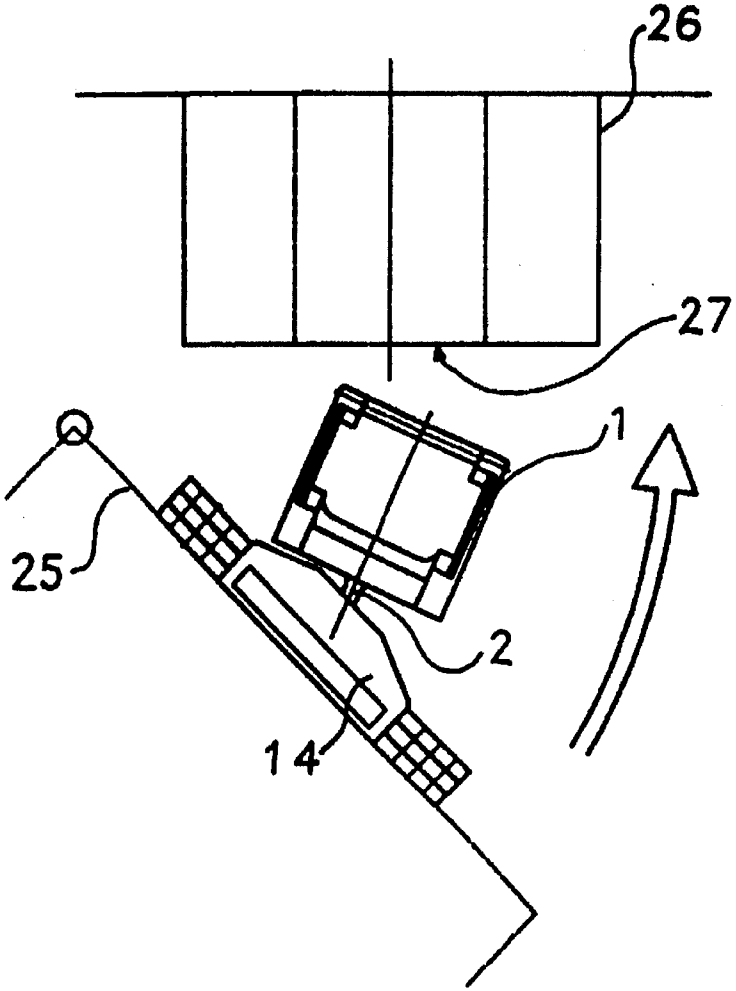
FIG. 7*a* is a schematic illustration of the radius actuator in accordance with FIG. 3*a* in a slanted position during initiation phase before entry in a safety switch.

FIG. 7*a* shows schematically the initiation phase of a radius actuator that is attached e.g. to a swingable door 25 and is adapted for operation of a safety switch 26 having an access opening 27. The operating key 1 of the radius actuator is tilted to the left and ready for insertion in the access opening 27. FIG. 7*b* illustrates the entry phase, with the operating key 1 now being aligned perpendicular to the safety switch 26 and kept in place against the spring force exerted by springs 5.

Figure 8B:
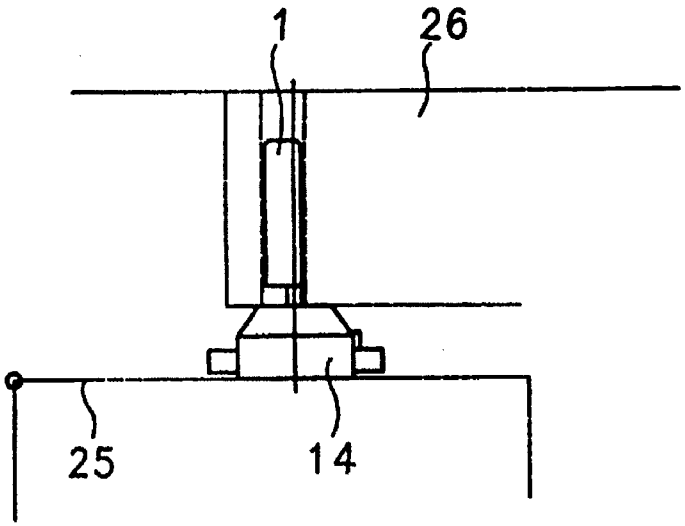
FIG. 8*b* is a schematic illustration of the radius actuator of FIG. 8*a* after entering the safety switch.
Figure 8A:
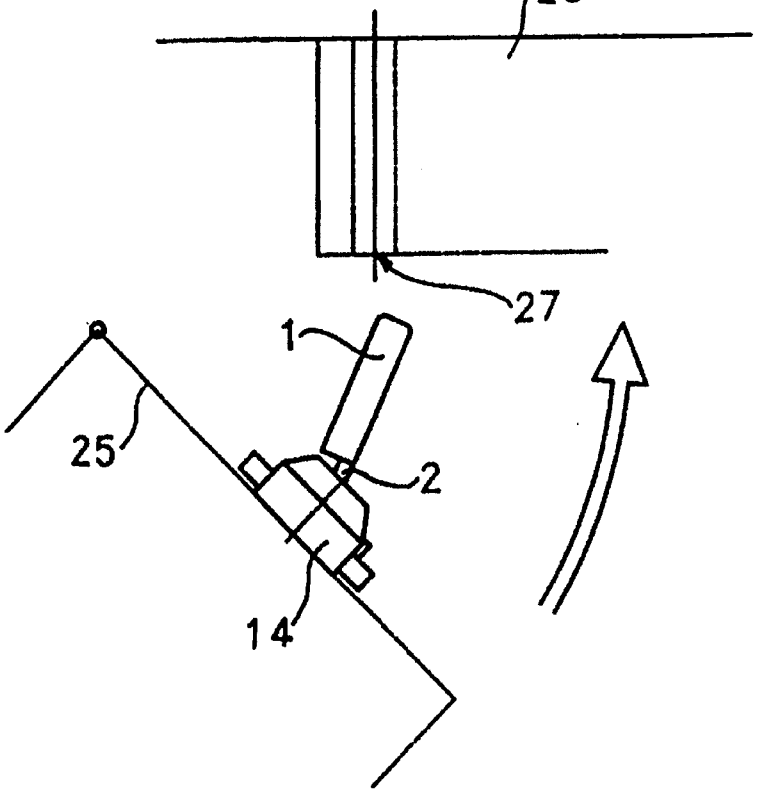
FIG. 8*a* is a schematic illustration of the radius actuator in accordance with FIG. 6*b* in a slanted position during initiation phase before entry in a safety switch.

FIGS. 8*a* and 8*b* show schematically a radius actuator with an operating key 1 tilted about its narrow side for insertion through the access opening 27 of the safety switch 26.

While the invention has been illustrated and described as embodied in a radius actuator for a safety switch, it is not intended to be limited to the details shown since various modifications and structural changes may be made without departing in any way from the spirit of the present invention.

What is claimed as new and desired to be protected by Letters Patent is set forth in the appended claims:

We claim:

1. A safety switch assembly; comprising:

a safety switch so designed as to be securable to an apparatus to be protected, said safety switch exhibiting an access opening; and a radius actuator securable to a movable part for displacement in direction toward the safety switch for operation thereof, said radius actuator including a mounting attached to the movable part, a slider retained in said mounting for movement therein in back and forth directions, an operating key received in said mounting and adapted for insertion in the access opening of the safety switch for effecting operation thereof, said operating key being moveable between a slanted initiation position and a switch-actuating position, said operating key being tiltable about a pivot axis outside said slider and having one end resiliently supported by said slider, and control means received in said mounting and adapted for cooperation with said slider for displacing said slider in either one of the directions.

2. The safety switch assembly of claim 1 wherein said control means includes a locking wheel rotatably supported in toothed rim sections of said mounting and placeable in said mounting in two positions offset by 90°, said locking wheel including a recess that is defined by a control cam for receiving said slider.

3. The safety switch assembly of claim 2 wherein said mounting is formed of two identical mounting parts that interlock together around said locking wheel.

4. The safety switch assembly of claim 3 wherein said mounting parts of said mounting have lateral attachment lugs which engage each other upon assembly of said mounting and include bores for passage of screw fasteners.

5. The safety switch assembly of claim 2 wherein said recess is further defined by a circularly arcuate section in opposition to said control cam, with said arcuate section merging into said control cam; said slider being of elongated configuration and having axial ends in form of rounded portions, with a plane boundary surface extending between said rounded portions and positioned adjacent said control cam in a neutral position before moving said operating key into the initiation position.

6. The safety switch assembly of claim 2 wherein said locking wheel has an external toothing in mesh with said toothed rim sections of said mounting, said mounting and said locking wheel being dimensioned such that said locking wheel partially protrudes beyond said mounting for allowing manual actuation thereof.

7. The safety switch assembly of claim 1 wherein said mounting has a through-opening formed by an inner wall surface of said mounting for defining said pivot axis.

8. The safety switch assembly of claim 7 wherein said through-opening is formed by a circumferential bead-like configuration of substantially triangular cross-section.

9. The safety switch assembly of claim 1 wherein said operating key has a head assembly provided with a square block for cooperation with guide surfaces of said slider.

10. A safety switch assembly; comprising:

a safety switch so designed as to be securable to an apparatus to be protected, said safety switch exhibiting an access opening; and a radius actuator securable to a movable part for displacement in direction toward the safety switch for operation thereof, said radius actuator including a mounting attached to the movable part, an operating key received in said mounting and adapted for insertion in the access opening of the safety switch for effecting operation thereof, said operating key being moveable between a selected angular initiation position with respect to said mounting and a switch-actuating position;

spring-loading means for urging said operating key into the selected angular position about a pivot axis; and control means acting upon said spring-loading means for setting and maintaining the selected angular position of said operating key when in the initiation position.

11. The safety switch assembly of claim 10 wherein said control means includes a locking wheel rotatably supported in toothed rim sections of said mounting and placeable in said mounting in two positions offset by 90°, said locking wheel including a recess that is defined by a control cam for cooperation with said spring-loading means.

12. The safety switch assembly of claim 11 wherein said mounting and said locking wheel are dimensioned such that said locking wheel partially protrudes from said mounting.

13. The safety switch assembly of claim 11 wherein said mounting is formed by two identical mounting parts interlocking each other around said locking wheel.

14. The safety switch assembly of claim 11 wherein said spring-loading means includes a slider received in said recess of said locking wheel, said operating key having a head assembly in form of a rod terminating in an end piece that is received in said slider and acted upon by two opposing springs.

15. The safety switch assembly of claim 14 wherein said mounting includes an opening defining said pivot axis for providing tiltable support for said head assembly outside said spring-loading means.

16. The safety switch assembly of claim 14 wherein said end piece is substantially cubical.

17. The safety switch assembly of claim 14 wherein said end piece is substantially spherical.

18. The safety switch assembly of claim 10 wherein said operating key is in a selected angular position while in the initiation position and is angularly displaced against a force exerted from said spring-loading means when in the switch-actuating position.

19. The safety switch assembly of claim 10 wherein said operating key is selectively mounted in each of two mutually orthogonal orientations relative to said mounting.

20. The safety switch assembly of claim 10 wherein said mounting is attached onto a swingable door element.

* * * * *